US008286647B2

(12) United States Patent
Bae

(10) Patent No.: US 8,286,647 B2
(45) Date of Patent: Oct. 16, 2012

(54) COSMETICS RECEPTACLE

(75) Inventor: Hae Dong Bae, Anyang (KR)

(73) Assignee: Taesung Industrial Co., Ltd., Anyang, Kyungki-do (KR)

( * ) Notice: Subject to any disclaimer, the term of this patent is extended or adjusted under 35 U.S.C. 154(b) by 126 days.

(21) Appl. No.: 12/908,436

(22) Filed: Oct. 20, 2010

(65) Prior Publication Data

US 2011/0271978 A1 Nov. 10, 2011

(30) Foreign Application Priority Data

May 10, 2010 (KR) ..... 20-2010-0004883 U

(51) Int. Cl.
*A45D 33/02* (2006.01)
*A45D 42/02* (2006.01)
*A45D 44/18* (2006.01)

(52) U.S. Cl. ..... 132/307; 132/313; 132/306; 132/305

(58) Field of Classification Search ..... 132/317, 132/313, 305, 306, 307, 300, 298–299, 293, 132/297; 401/127, 126, 131, 130
See application file for complete search history.

(56) References Cited

U.S. PATENT DOCUMENTS

| | | | | |
|---|---|---|---|---|
| 3,951,157 | A * | 4/1976 | Idec | 401/122 |
| 6,447,191 | B1 * | 9/2002 | Vasas | 401/7 |
| 6,773,187 | B2 * | 8/2004 | Gueret | 401/130 |
| 7,226,227 | B2 * | 6/2007 | Gueret | 401/18 |
| 7,381,003 | B1 * | 6/2008 | Chang | 401/130 |
| 7,673,636 | B2 * | 3/2010 | Pires et al. | 132/306 |
| 2003/0000543 | A1 * | 1/2003 | Kim | 132/313 |

* cited by examiner

*Primary Examiner* — Robyn Doan
(74) *Attorney, Agent, or Firm* — Lowe Hauptman Ham & Berner, LLP

(57) ABSTRACT

A cosmetics receptacle includes: a container part having a container opening, a container cap combined with the container part, a guide tube part including a pair of guide grooves dotted-formed from an upper end along a length-wise direction, a brush holder having a tube-shaped brush seating tube with a closed upper side, a sliding tube disposed in such a manner that the sliding tube surrounds the brush seating tube and a pair of guide projections extending from an outer surface of the brush seating tube, a brush mounted in the brush seating tube in such a manner that the brush is exposed by passing the lower end of the guide tube part when the brush holder moves along the length-wise direction of the guide tube part, and a separation preventing cap combined with the upper end of the guide tube part.

2 Claims, 8 Drawing Sheets

COSMETICS RECEPTACLE

BACKGROUND OF THE INVENTION

1. Field of the invention

The present invention relates to a cosmetics receptacle, and more particularly to a cosmetics receptacle having a container part for storing cosmetics in a powder type, a liquid type or a solid type, and a brush for retrieving and applying the cosmetics stored in the container part.

2. Description of the Prior Art

Some cosmetic products such as eye-shadow, cosmetic powder, etc., have to be applied on a facial treatment area by using a brush. For such cosmetic products using a brush, as described above, a cosmetics receptacle which has a container part for storing cosmetics and a brush for retrieving and applying the cosmetics stored in the container part has been invented and used.

FIG. 6 is an assembled perspective view illustrating a conventional cosmetics receptacle, FIG. 7 is an exploded perspective view illustrating a conventional cosmetics receptacle, and, FIG. 8 is a cross-sectional view illustrating a conventional cosmetics receptacle.

The conventional cosmetics receptacle, as shown in the drawings, includes a container part 110 having a container opening 110*a*, a container cap 121 combined with the container part 110 in such a manner that it can open/close the container opening 110*a*, and a brush 123 combined with the container cap 121.

The container part 110 includes an upwardly opened lower container part 111, and an upwardly opened upper container part 112 detachably combined to the upper end of the lower container part 111.

The upper container part 112 has powder passing holes 112*a* formed in the bottom surface thereof.

The container cap 121 is screw-assembled to the upper container part 112 in such a manner that it can open/close the opening of the upper container part 112.

The brush 123 has a length section which reaches the bottom surface of the upper container part 112 when the container cap 121 is combined with the upper container part 112.

Hereinafter, the method for using the conventional cosmetics receptacle having the above described configuration will be described.

First, after separation of the lower container part 111 from the upper container part 112, powder-type cosmetics are stored in the lower container part 111.

Then, in order to pass the cosmetics through the powder passing holes 112*a*, the lower container part 111 is upside down, and the cosmetics are retrieved by the brush 123.

Then, the container cap 121 is detached, and the brush 123 is placed in contact with the facial treatment area.

However, in the conventional cosmetics receptacle, the container cap 121 (functioning as a brush holder of the present invention) has to be held to move the brush 123, which has caused a problem in that the use of the brush is inconvenient due to the short holding section.

Also, since the brush 123 is stored while being exposed, it is difficult to keep the brush 123 clean, and also the arrangement state of the brush 123 is scattered when the container cap 121 is combined with the upper container part 112 (in other words, brush hairs are folded outward by being entangled in the upper container part while advancing to the upper container part).

SUMMARY OF THE INVENTION

Accordingly, the present invention has been made to solve the above-mentioned problems occurring in the prior art, and the present invention provides a cosmetics receptacle which can be easily used and allows the clean state and the arrangement state of a brush to be stably maintained.

In accordance with an aspect of the present invention, there is provided a cosmetics receptacle which has a container part having a container opening, and a container cap combined with the container part in such a manner that the container cap opens and closes the container opening, the cosmetics receptacle including: a guide tube part which includes a pair of guide grooves dotted-formed from an upper end along a length-wise direction, and is combined with an upper end of the container cap in such a manner that the guide grooves are disposed at an upper side, each of the guide grooves being formed with an upper stopper protrusion; a brush holder having a tube-shaped brush seating tube with a closed upper side, a sliding tube disposed in such a manner that the sliding tube surrounds the brush seating tube, and a pair of guide projections extending from an outer surface of the brush seating tube, which is provided in the guide tube part in such a manner that the guide projections are disposed at an upper side of the upper stopper protrusion and the brush holder passes the upper stopper protrusion and moves along the length-wise direction of the guide tube part by an operation of pressing the brush holder toward a lower end of the guide tube part, the pair of guide projections being formed at two positions with a phase difference corresponding to the pair of guide grooves while reaching an inner surface of the sliding tube; a brush mounted in the brush seating tube in such a manner that the brush is exposed by passing the lower end of the guide tube part when the brush holder moves along the length-wise direction of the guide tube part; and a separation preventing cap combined with the upper end of the guide tube part in such a manner that the separation preventing cap is disposed at the upper side of the brush holder.

Herein, in order to reduce the mounting space of the guide tube part, preferably, in the container cap, an escape space for the advance through an upper area is formed, and the guide tube part is combined with the container cap in such a manner that the guide tube part is advanced into the escape space.

According to the present invention, the brush holder is provided in the guide tube part in such a manner that it can move along the length-wise direction of the guide tube part combined with the upper end of the container cap. Also, the brush is combined with the brush holder in such a manner that it can be exposed by passing the lower end of the guide tube part when the brush holder is moved. Thus, the use of the brush can be easy because the holding area is lengthened when the brush is used.

Furthermore, when kept, the brush is advanced to the inside of the guide tube part. Thus, it is possible to stably maintain the clean state of the brush. Also, when the brush is advanced to the inside of the guide tube part, the brush hairs are put together by the guide tube part. Thus, it is possible to stably maintain the arrangement state of the brush.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, the present invention will be described in detail with reference to the accompanying drawings.

Figure 1:
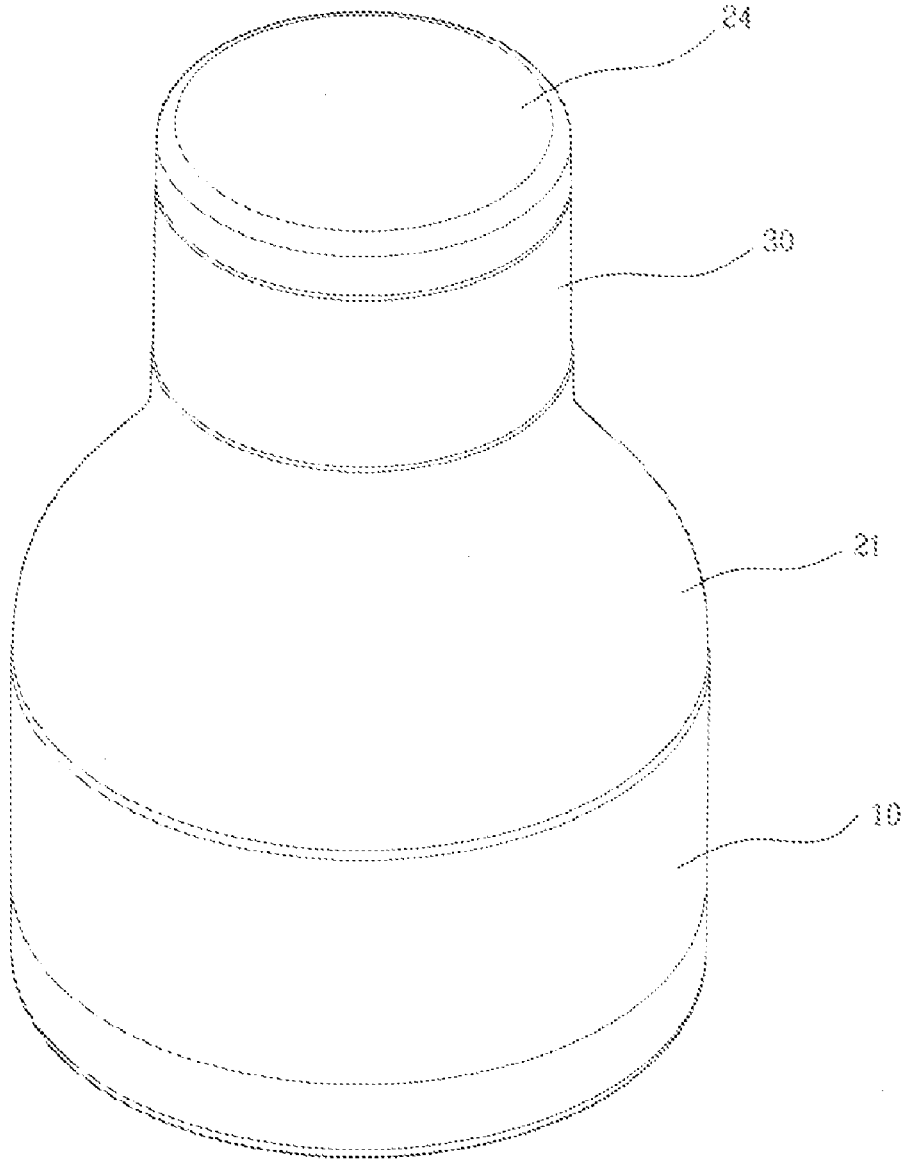
FIG. 1 is an assembled perspective view illustrating a cosmetics receptacle according to an embodiment of the present invention.
Figure 2:
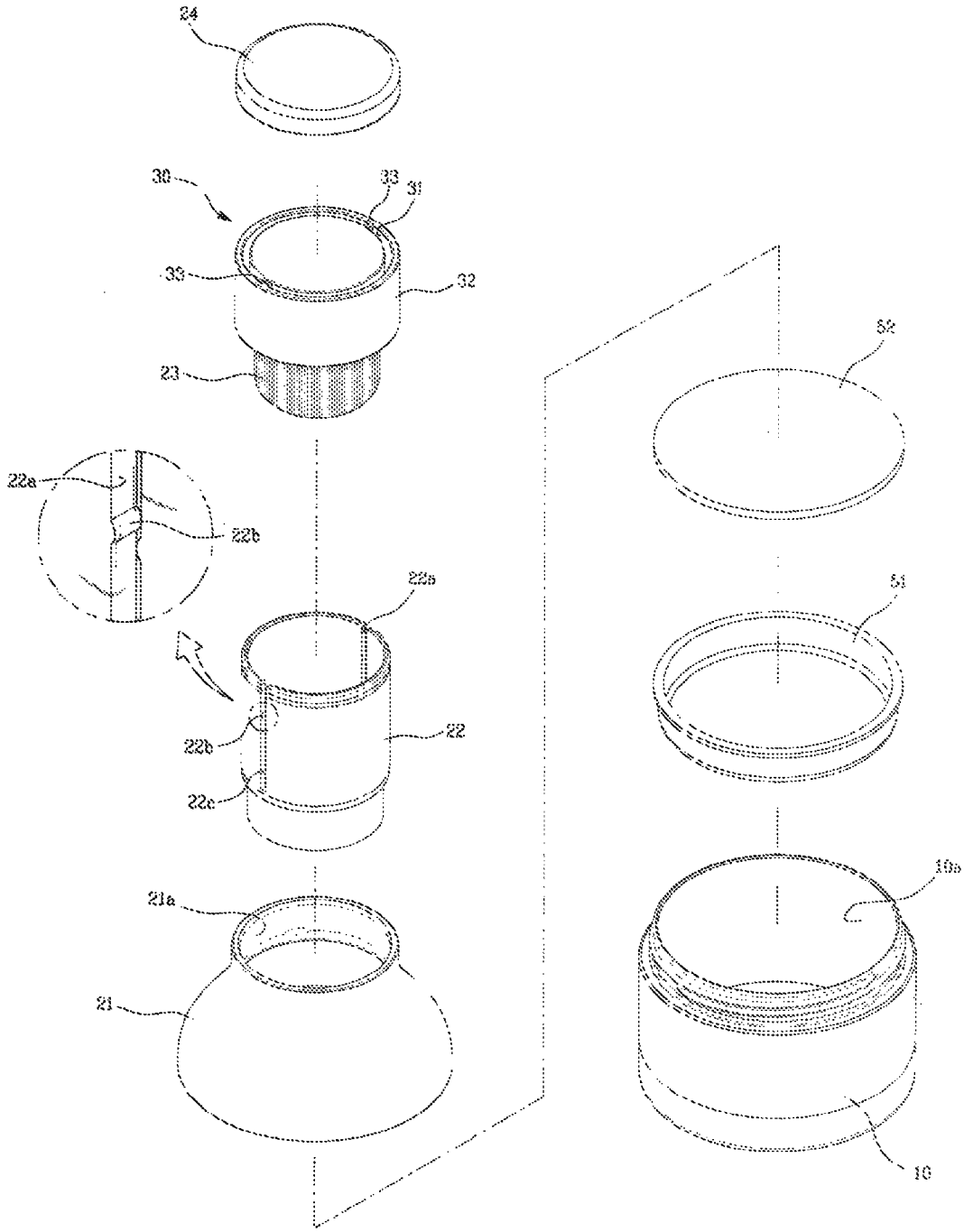
FIG. 2 is an exploded perspective view illustrating a cosmetics receptacle according to an embodiment of the present invention.
Figure 3:
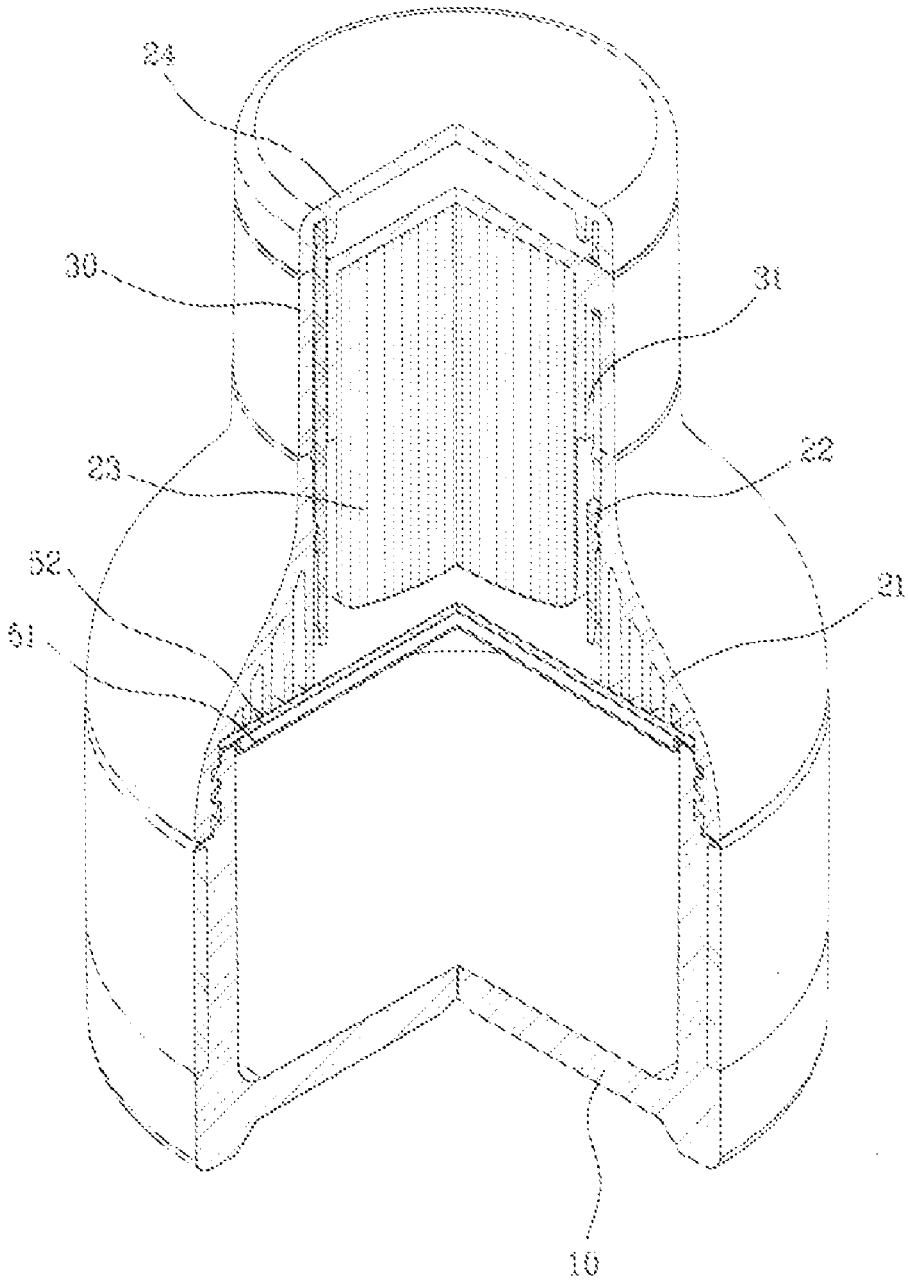
FIG. 3 is a partially cut-away cross-sectional view illustrating a cosmetics receptacle according to an embodiment of the present invention.
Figure 4:
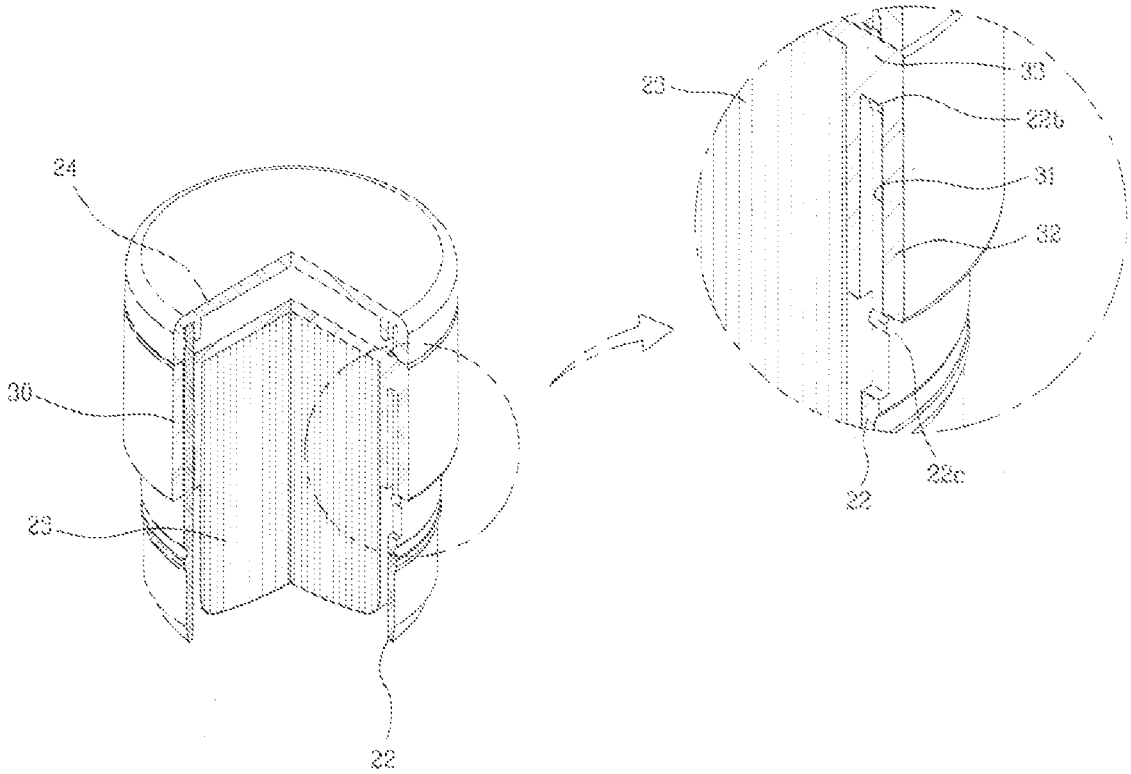
FIG. 4 is a detailed view illustrating a brush holder area of a cosmetics receptacle according to an embodiment of the present invention.

FIG. 1 is an assembled perspective view illustrating a cosmetics receptacle according to an embodiment of the present invention, FIG. 2 is an exploded perspective view illustrating a cosmetics receptacle according to an embodiment of the present invention, FIG. 3 is a partially cut-away cross-sectional view illustrating a cosmetics receptacle according to an embodiment of the present invention, and FIG. 4 is a detailed view illustrating a brush holder area of a cosmetics receptacle according to an embodiment of the present invention.

The cosmetics receptacle according to an embodiment of the present invention, as shown in the drawings, includes a container part 10 having a container opening 10*a*, a container cap 21 combined with the container part 10 in such a manner that it can open/close the container opening 10*a*, a guide tube part 22 combined with the upper end of the container cap 21, a brush holder 30 provided in the guide tube part 22, a brush 23 mounted in a brush seating tube 31, and a separation preventing cap 24 combined with the upper end of the guide tube part 22.

In the container part 10, cosmetics are stored, and the container opening 10*a* of the container part 10 storing the cosmetics is temporarily tightly closed by a packing 51.

In the container cap 21, an escape space 21*a* for the advance through the upper area is formed.

The lower-side opening of the container cap 21 is tightly closed by an airtight member 52.

The guide tube part 22 includes a pair of guide grooves 22*a* which are dotted-formed from the upper end along the length-wise direction with a phase difference of 180°.

In the guide groove 22*a*, an upper stopper protrusion 22*b*, and a lower stopper protrusion 22*c* are formed.

The guide tube part 22 having the above described configuration is combined with the container cap 21 in such a manner that the guide grooves 22*a* are disposed at the upper side and advanced into the escape space 21*a*.

The brush holder 30 includes a tube-shaped brush seating tube 31 with a closed upper side, a sliding tube 32 disposed in such a manner that it can surround the brush seating tube 31, and a pair of guide projections 33 extending from the outer surface of the brush seating tube 31.

The pair of guide projections 33 are positioned at two positions with a phase difference of 180° while reaching the inner surface of the sliding tube 32.

The brush holder 30 having the above described configuration is provided in such a manner that the guide projections 33 are disposed at the upper side of the upper stopper protrusion 22*b*.

Also, the brush holder 30 can pass the upper stopper protrusion 22*b* and move along the length-wise direction of the guide tube part 22 by the operation of pressing the brush holder toward the lower end of the guide tube part 22. Herein, the movement of the brush holder 30 is limited by the lower stopper protrusion 22*c*.

The brush 23 is mounted in the brush seating tube 31 in such a manner that it can be exposed by passing the lower end of the guide tube part 22 when the brush holder 30 moves along the length-wise direction of the guide tube part 22.

The separation preventing cap 24 is combined with the guide tube part 22 at the upper side of the brush holder 30.

Figure 5:
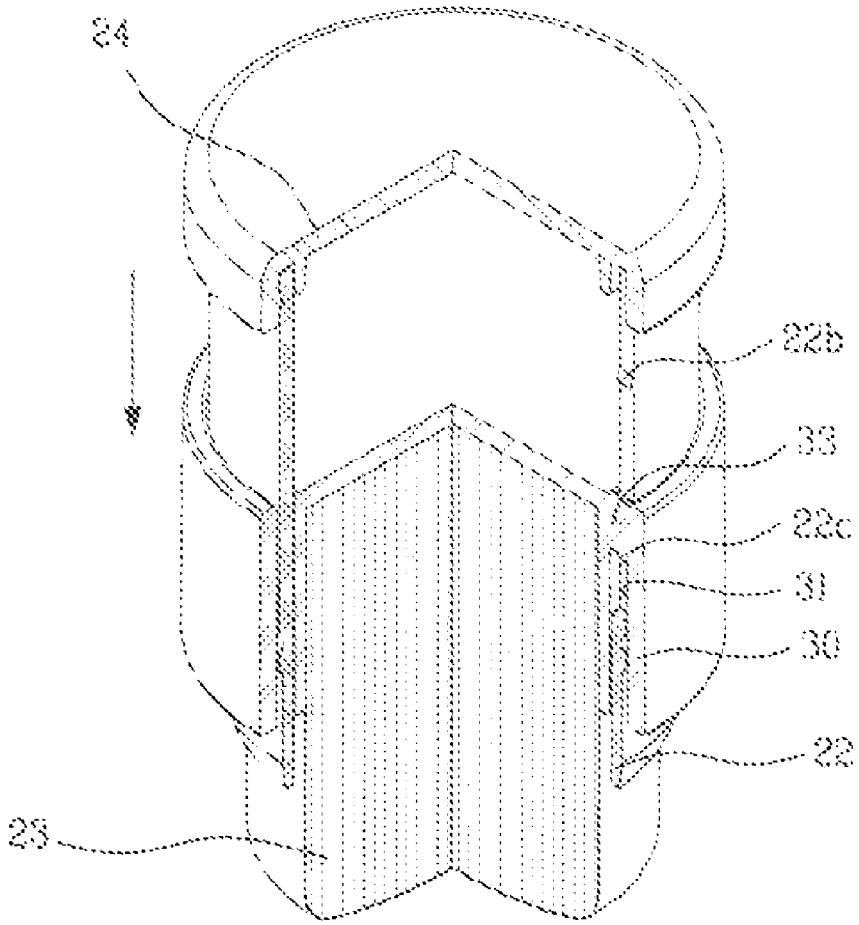
FIG. 5 is a view illustrating a method for using a cosmetics receptacle according to an embodiment of the present invention.
Figure 6:
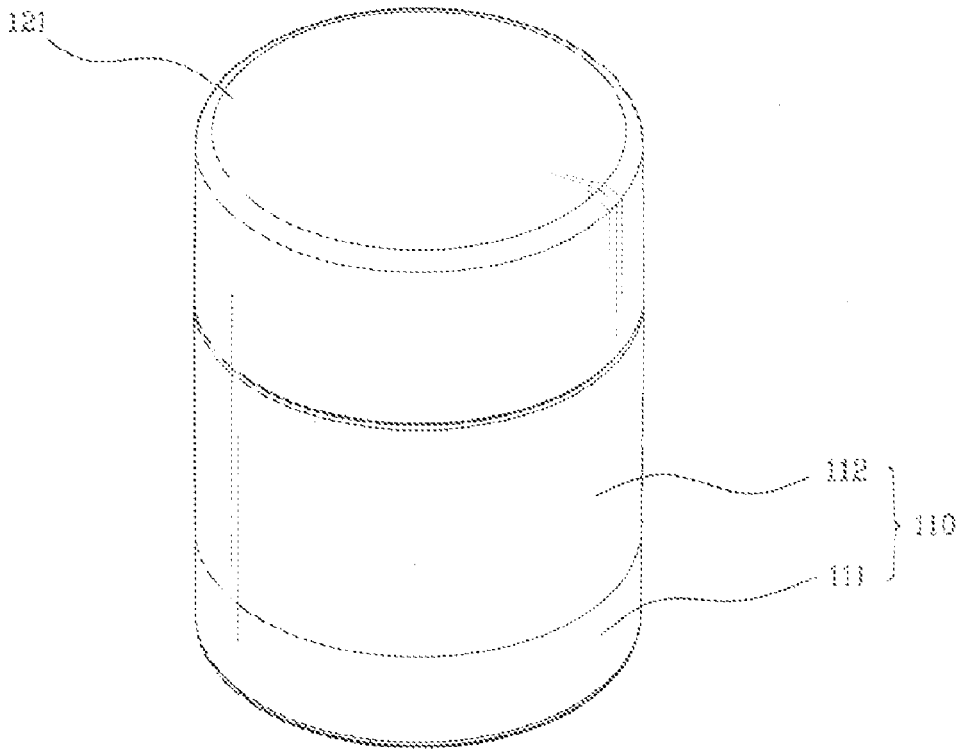
FIG. 6 PRIOR ART
FIG. 6 is an assembled perspective view illustrating a conventional cosmetics receptacle.
Figure 7:
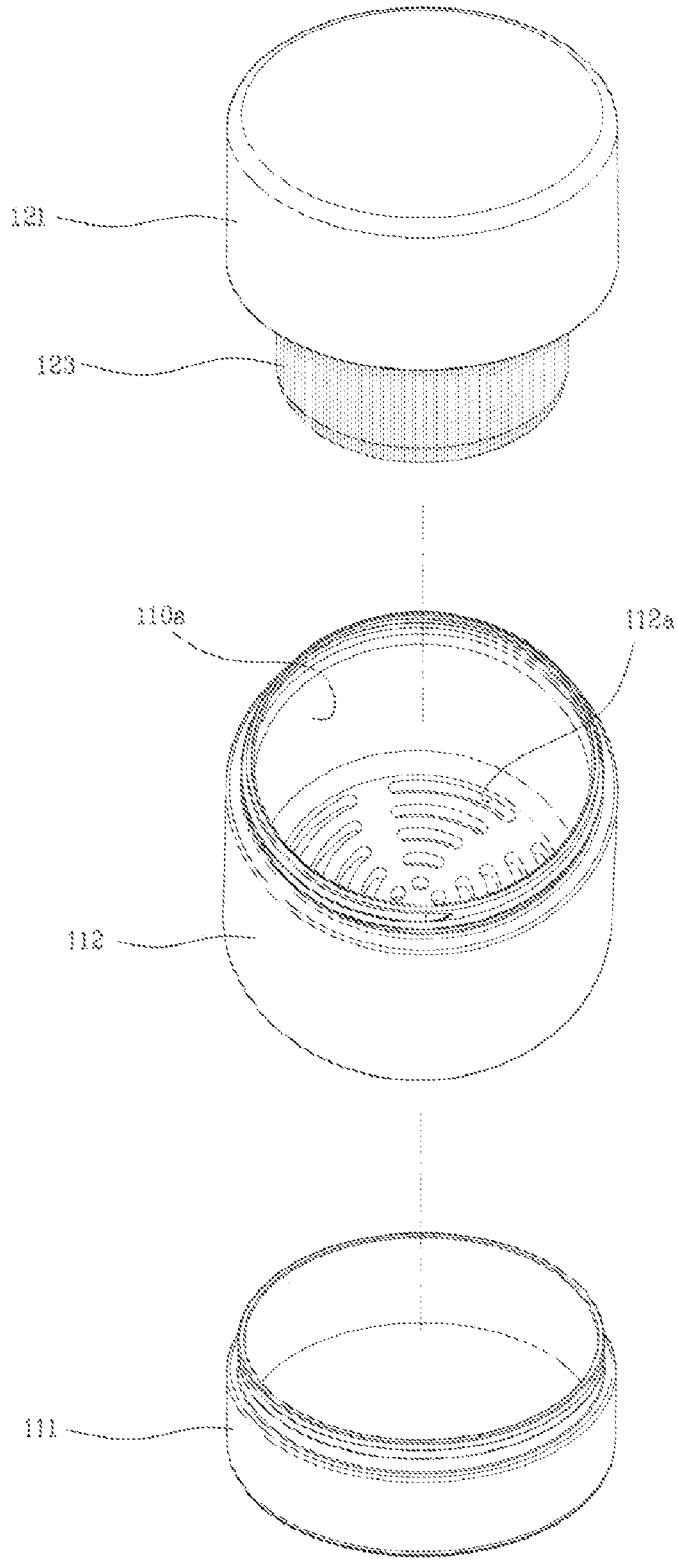
FIG. 7 PRIOR ART
FIG. 7 is an exploded perspective view illustrating a conventional cosmetics receptacle.
Figure 8:
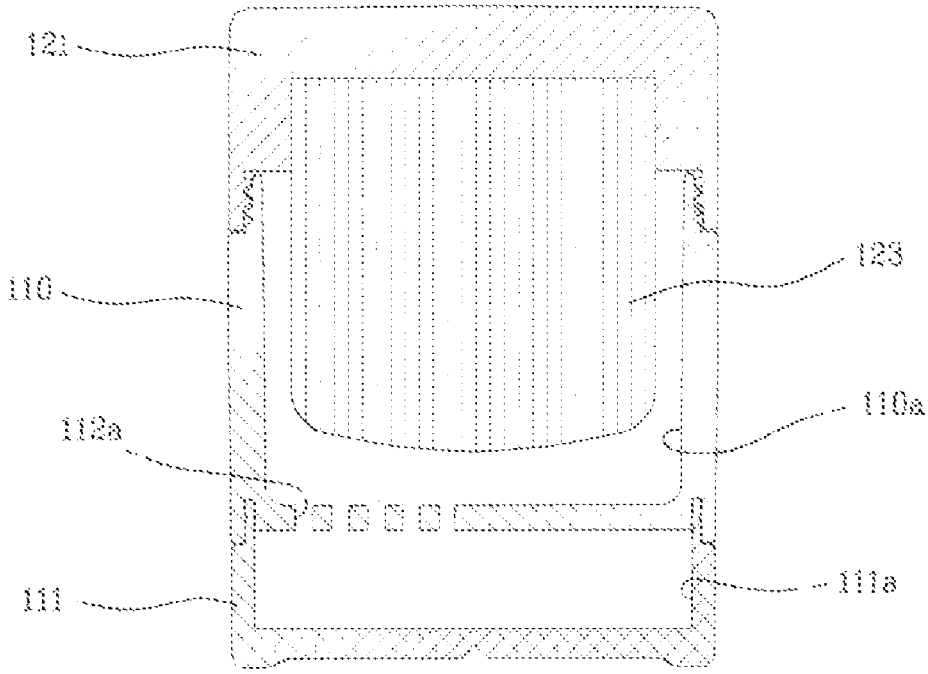
FIG. 8 PRIOR ART
FIG. 8 is a cross-sectional view illustrating a conventional cosmetics receptacle.

Hereinafter, a method for using the cosmetics receptacle having the above described configuration, according to an embodiment of the present invention, will be described with reference to FIG. 5. For convenience of description, it is assumed that the container part 10 stores cosmetics, and the packing 51 is removed.

First, the container cap 21 is detached from the container part 10.

Then, the brush holder 30 is detached from the container cap 21.

Then, the brush holder 30 is moved downward so that the brush 23 can be exposed by passing the lower end of the guide tube part 22.

Then, the brush 23 is put in the container part 10 and retrieves cosmetics.

Then, the brush 23 is contacted with a facial treatment area.

After the facial treatment, the brush holder 30 is moved upward so that the brush 23 can be advanced to the inside of the guide tube part 22.

Then, the brush holder 30 is combined with the container cap 21.

Last, the container cap 21 is combined with the container part 10.

As described above, according to an embodiment of the present invention, the brush holder 30 is provided in the guide tube part 22 in such a manner that it can move along the length-wise direction of the guide tube part 22 combined with the upper end of the container cap 21. Also, the brush 23 is combined with the brush holder 30 in such a manner that the brush 23 can be exposed by passing the lower end of the guide tube part 22 when the brush holder 30 is moved. Thus, the use of the brush can be easy because the holding area is lengthened when the brush is used.

Furthermore, when kept, the brush 23 is advanced to the inside of the guide tube part 22. Thus, it is possible to stably maintain the clean state of the brush 23. Also, when the brush is advanced to the inside of the guide tube part 22, the brush hairs are put together by the guide tube part 22. Thus, it is possible to stably maintain the arrangement state of the brush 23.

Also, since the container cap 21 is formed with the escape space 21*a*, and the guide tube part 22 is combined with the container cap 21 in such a manner that it can advance into the escape space 21*a*, it is possible to reduce the space for mounting the guide tube part 22.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A cosmetics receptacle which has a container part having a container opening, and a container cap combined with the container part in such a manner that the container cap opens and closes the container opening, the cosmetics receptacle comprising:

a guide tube part which comprises a pair of guide grooves dotted-formed from an upper end along a length-wise direction, and is combined with an upper end of the container cap in such a manner that the guide grooves are disposed at an upper side, each of the guide grooves being formed with an upper stopper protrusion;

a brush holder having a tube-shaped brush seating tube with a closed upper side, a sliding tube disposed in such a manner that the sliding tube surrounds the brush seating tube, and a pair of guide projections extending from an outer surface of the brush seating tube, which is provided in the guide tube part in such a manner that the guide projections are disposed at an upper side of the upper stopper protrusion and the brush holder passes the upper stopper protrusion and moves along the length-wise direction of the guide tube part by an operation of pressing the brush holder toward a lower end of the guide tube part, the pair of guide projections being formed at two positions with a phase difference corresponding to the pair of guide grooves while reaching an inner surface of the sliding tube;

a brush mounted in the brush seating tube in such a manner that the brush is exposed by passing the lower end of the guide tube part when the brush holder moves along the length-wise direction of the guide tube part; and a separation preventing cap combined with the upper end of the guide tube part in such a manner that the separation preventing cap is disposed at the upper side of the brush holder.

2. The cosmetics receptacle as claimed in claim 1, wherein in the container cap, an escape space for advance through an upper area is formed, and the guide tube part is combined with the container cap in such a manner that the guide tube part is advanced into the escape space.

* * * * *